United States Patent [19]

Watkins

[11] 4,029,019

[45] June 14, 1977

[54] TRACK FOR VEHICLES

[75] Inventor: William M. Watkins, West Covina, Calif.

[73] Assignee: Walt Disney Productions, Burbank, Calif.

[22] Filed: Nov. 14, 1975

[21] Appl. No.: 631,892

[52] U.S. Cl. ..... 104/124; 104/1 R; 104/107; 104/125

[51] Int. Cl.[2] ..... B61B 12/00; B61B 5/04; E01B 25/22

[58] Field of Search ..... 104/53, 56, 63, 64, 104/67, 107, 106, 118, 119, 124, 125, 126, 1 R; 238/15

[56] References Cited

UNITED STATES PATENTS

| | | | |
|---|---|---|---|
| 3,841,223 | 10/1974 | Bertin | 104/124 X |
| 3,919,947 | 11/1975 | Simon et al. | 104/124 |
| 3,922,970 | 12/1975 | Glastra | 104/106 X |
| 3,949,680 | 4/1976 | Doughty | 104/124 |

*Primary Examiner*—Stanley H. Tollberg
*Assistant Examiner*—Fred A. Silverberg
*Attorney, Agent, or Firm*—Fulwider, Patton, Rieber, Lee & Utecht

[57] ABSTRACT

A track for vehicles which is particularly adapted for amusement park rides having a plurality of banked curves. The track comprises a pair of track rails connected to a lower backbone pipe. In curved sections, the plane of the track rails extends at varying banked angles around the course line of the track. In such sections, the distances between the plane of the track rails and the backbone pipe varies in direct relationship to the bank angle of the curve. The distance between the plane of the track rails and the course line remains constant. The plane of the backbone pipe also remains parallel to the plane of the course line. The course line is preferably disposed a substantial distance above the plane of the track rails.

6 Claims, 6 Drawing Figures

FIG. 1A
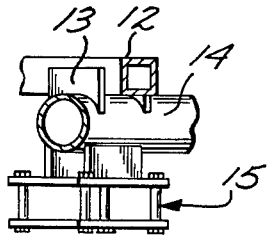
FIG. 1
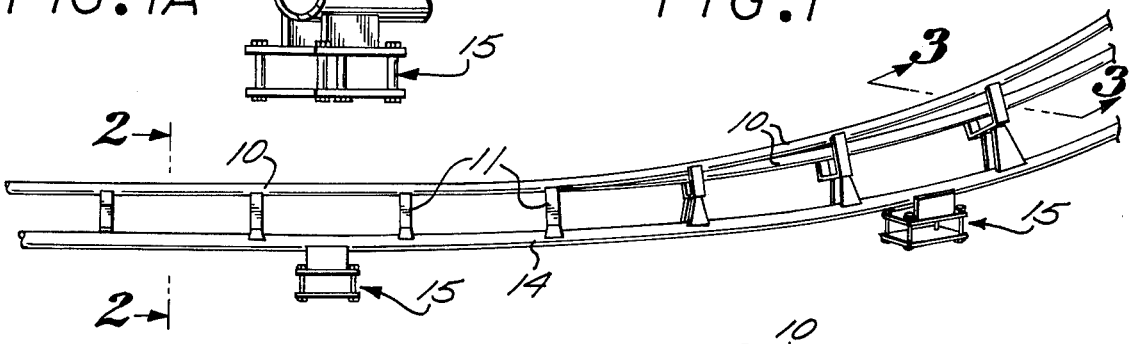
FIG. 3
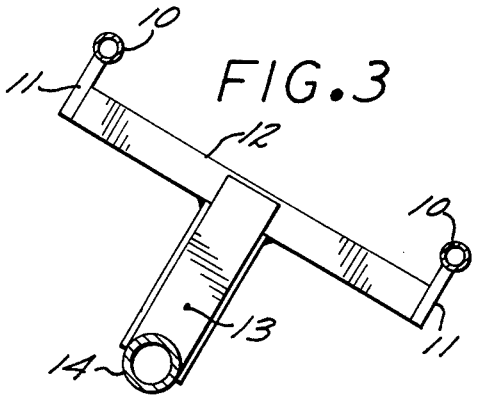
FIG. 2
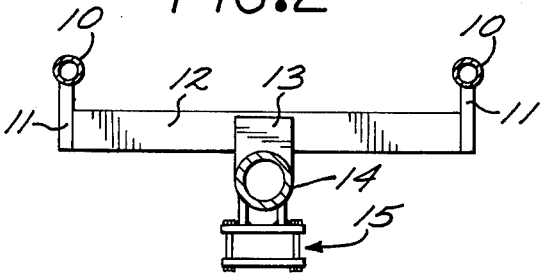
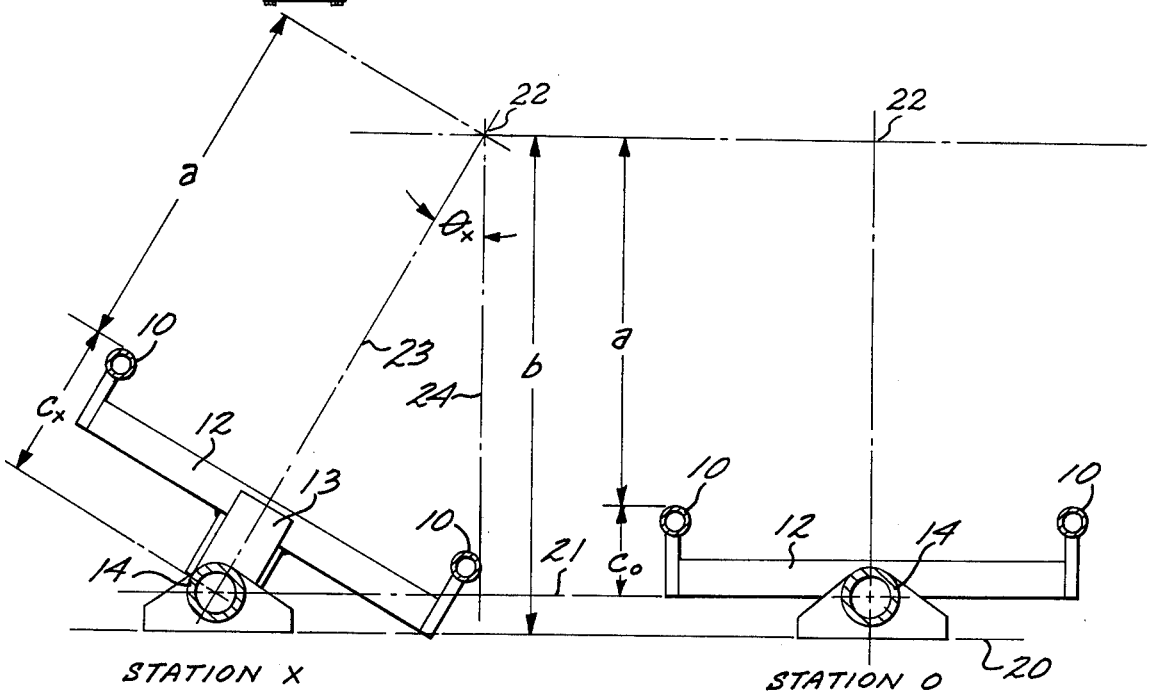
FIG. 4

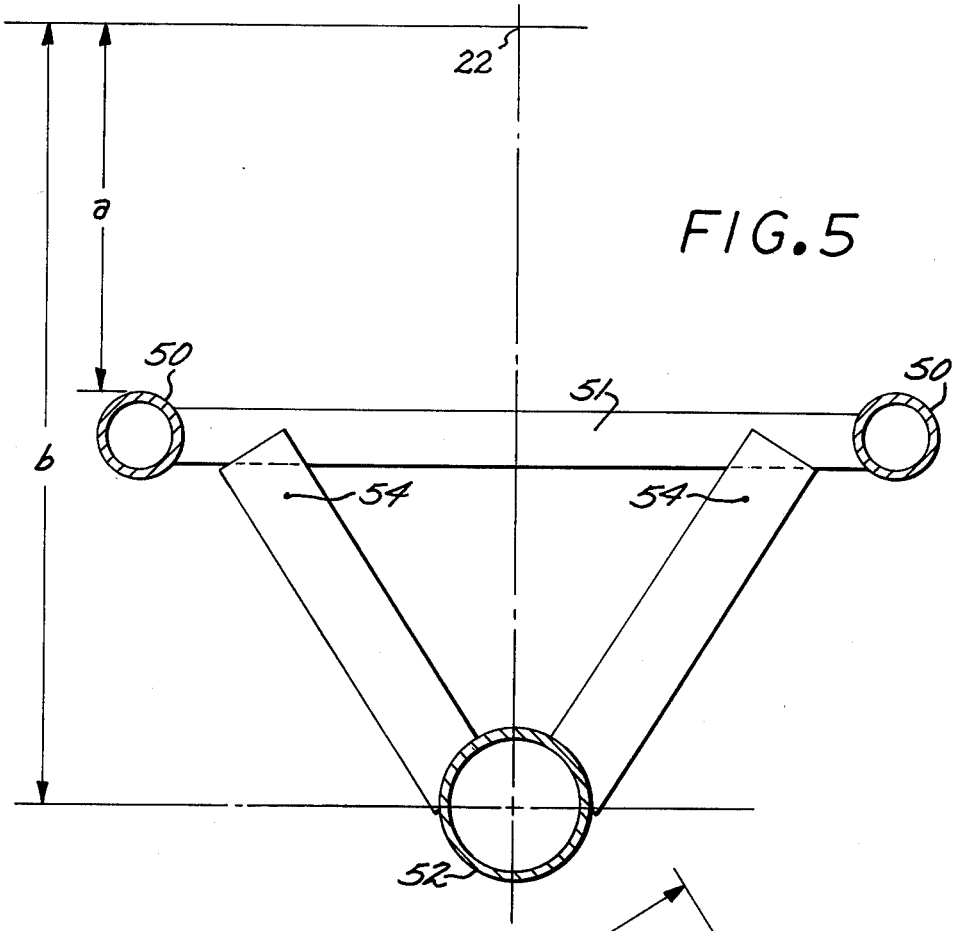
FIG. 5
FIG. 6
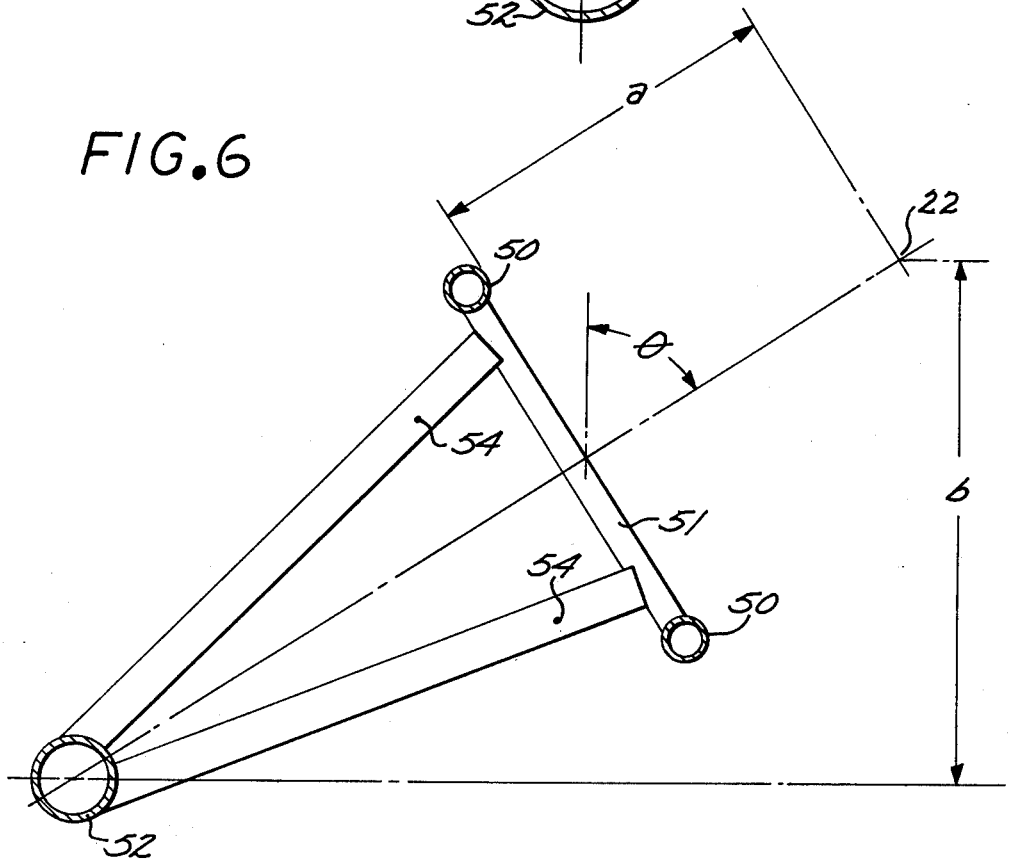

TRACK FOR VEHICLES

BACKGROUND OF THE INVENTION

1. Field of the Invention

The invention relates to a track for vehicles which is particularly adapted for amusement park rides having a plurality of banked curves.

2. Description of the Prior Art

In prior practice, where tri-rail construction has been used, the banking is established around the backbone pipe. This results in the center of gravity of the vehicle being swung downwardly through an arc, moving the side of the vehicle into contact with the passengers. Banking of the vehicle about a point which is elevated above the plane of the track would require compound bending of the backbone pipe.

Other track sections comprise two rails with no backbone pipe and banking is usually accomplished by superelevating the outer rail relative to the inner rail. This, too, results in a radical shift of the center of gravity of the vehicle.

SUMMARY OF THE INVENTION

The present invention comprises a new approach to track curve design which provides a smooth transition out of the straight sections and which in its curved sections provides rolling of the vehicle about a line disposed above the top surface of the rails. The invention provides a means of constructing such a track.

The track of this invention comprises three primary members, two rails and a support or backbone pipe. However, a novel feature is that the depth of the resulting composite beam is not a constant, but varies as the bank angle changes. This permits the backbone member to remain in a flat plane, parallel to the plane of the course line, thereby avoiding the need to perform difficult compound bends and providing a simple interface with the supporting structure. Another advantage is that as centrifugal forces increase, bank angles increase, and as bank angles increase, beam depth increases. Therefore, a stronger beam results in the areas where loads are the highest.

The invention contemplates the provision of a particular relationship between the two track rails and the backbone pipe in a tri-rail beam section. A constant vertical dimension is also held between the course line and the backbone pipe. Therefore, when banking occurs, the distance from the top of the rail to the backbone increases. This is an advantage because deeper and stronger sections are provided where loads are highest.

There is also a much greater dimensional tolerance for backbone shape, since any deviations can be compensated by adjusting the lengths of the structural members connecting the rail ties to the backbone.

While there are shown in the accompanying drawings preferred embodiments of the invention, it should be understood that the same are susceptible to modification and change without departing from the spirit of the invention.

DESCRIPTION OF THE DRAWINGS

Fig. 1 is a side elevational view of a section of track;

FIG. 1a is a partial perspective view of the backbone pipe assembly;

FIG. 2 is an enlarged sectional view of a straight section taken on line 2—2 of FIG. 1;

FIG. 3 is an enlarged sectional view of a curved section taken on line 3—3 of FIG. 1;

FIG. 4 is a schematic view showing the relationship between the structural elements of the track in a straight section on the right and a curved section on the left;

FIG. 5 is a sectional view comparable to FIG. 2 showing a straight track section of another embodiment of the invention; and FIG. 6 is a sectional view similar to FIG. 3 showing a curved track section of such embodiment of the invention.

DESCRIPTION OF THE PREFERRED EMBODIMENT

A first preferred embodiment which has been selected to illustrate the invention is shown in FIGS. 1–3 of the drawings. The track structure comprises a pair of spaced track rails 10, which may be formed of 2 inches extra strong pipe which is relatively easy to bend. The track rails 10 are supported by a pair of track supports 11 which extend upwardly from the opposite ends of a plurality of transversely directed cross members 12. The cross members 12 are disposed at spaced intervals along the track.

A support member 13 is connected at its upper end to the midportion of each cross member 12 and is attached at its lower end to a backbone pipe 14. The backbone pipe 14 may be formed of 3½ inches standard pipe.

The backbone pipe 14 is supported at spaced intervals by a support structure which comprises an adjustable base plate 15. The base plates 15 are attached to a track supporting framework which is not shown in the drawings because it is conventional and well known to those skilled in the art.

It will be understood that the physical structure of the track may be varied as desired. The configuration of the track structure is not a critical part of the invention, except insofar as the relationship between the course line, the track rails and the backbone pipe is concerned.

FIG. 4 of the drawings is a schematic illustration of the relationship between the elements of the track structure which comprises the present invention. The bottom line 20 in FIG. 4 represents a structural interface or support base along which the backbone pipe 14 extends. Directly above it is a parallel line 21, which represents the plane of the backbone centerline 14.

The course line along which the track extends is the line which defines the routing of the track and is ideally positioned to be about ten inches above the seat of the vehicle in order to impart a minimum of lateral force to the passenger when transitioning into a banked turn. The course line is indicated by the upper line 22.

The left side of FIG. 4 represents a cross-section taken in a curved section of track designated as Station X. The right side of FIG. 4 represents a cross-section taken in a straight track section designated as Station O.

It will be noted that the plane of the structural interface (line 20) and the plane of the backbone pipe 14 (line 21) remain at all times in a plane parallel to the course line (line 22) in both straight and curved sections of the track.

In both straight and curved sections of the track, a constant dimension is maintained between the course line about which the banking takes place and the plane of the track rails 10. This is represented by the dimension *a* on both sides of FIG. 4. A constant vertical dimension *b* is also maintained between the course line and the plane of the structural interface.

In a curve, the bank angle, which is represented in FIG. 4 as $\theta x$ comprises the angle between the normal axis of the track section, represented by line 23 in FIG. 4, and a vertical line represented by line 24.

When the bank angle is zero, the distance between the plane of the backbone pipe 14 and the plane of the track rails 10 is at a minimum, represented in the drawing as $c_o$. When the bank angle is $\theta$x, the distance is substantially greater, as indicated on the left side of FIG. 4 by the distance $c_x$. This *c* dimension represents the depth of the track section, which varies in direct relationship to variations in the bank angle in order to maintain the backbone pipe 14 in a plane parallel to the course line.

Since the backbone pipe 14 is maintained in a plane parallel to the course line, no compound bending of the backbone pipe is required. There is also much greater dimensional tolerance for the shape of the backbone pipe 14, since any deviations can be compensated for by adjusting the height of the structural members, such as the support members 13, which connect the rail tracks 10 (via supports 11 and cross members 12) to the backbone pipe 14.

As vehicles travel around a given radius at higher speeds, greater forces are generated and higher banking is required. As such banking is provided, the distances from the track rails to the backbone pipe is increased. Therefore, a deeper and stronger section is provided where the loads are the highest.

FIGS. 5 and 6 of the drawings show another configuration of track structure in which the principles of the invention are embodied.

In this embodiment a pair of track rails 50 are mounted on opposite ends of a cross member 51. A backbone pipe 52 is welded to a pair of support members 54 of channel section which are attached at their opposite ends to the cross member 51.

FIG. 5 illustrates a straight section of track. FIG. 6 illustrates a curved section of track. It will be noted that the magnitude of values *a* and *b* is the same in both cases.

I claim:

1. A track for vehicles comprising a pair of spaced parallel track rails connected to a backbone member disposed beneath said track rails, said track having a plurality of curved sections in which the plane of said track rails extends at varying bank angles around a course line coextensive with and at a constant perpendicular distance thereto, the distance between the plane of said track rails and said backbone member in said curved sections varying in direct relationship to the bank angle of the curve, while the vertical distance between two parallel planes containing, respectively, said backbone member and said course line remains constant.

2. The structure described in claim 1, in which said backbone member lies in a substantially flat plane substantially parallel said course line, to avoid bending said backbone member into compound curves.

3. The structure described in claim 2, wherein said course line is disposed a substantial distance above the plane of said track rails and defined by a point within a vehicle on said rails located so as to minimize lateral acceleration of passengers in said vehicles due to angular acceleration about the bank angle axis.

4. The structure described in claim 1, and a plurality of support members extending between said backbone member and said track rails, the lengths of said support members increasing as the bank angle increases, to provide greater beam depth and strength in areas of increased centrifugal force.

5. The structure described in claim 4, said support members being formed in pre-determined lengths to minimize layout computations and speed construction of said track.

6. The track of claim 1 wherein said plane of said track rails is banked at angles to provide rolling of a vehicle traversing said tracks about said course line.

* * * * *